US008007289B2

(12) United States Patent
Bandhu et al.

(10) Patent No.: US 8,007,289 B2
(45) Date of Patent: Aug. 30, 2011

(54) CONNECTOR APPARATUS

(75) Inventors: Saujit Bandhu, Singapore (SG); Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/529,737

(22) PCT Filed: Mar. 4, 2008

(86) PCT No.: PCT/US2008/055814

§ 371 (c)(1),
(2), (4) Date: Sep. 3, 2009

(87) PCT Pub. No.: WO2008/109612

PCT Pub. Date: Sep. 12, 2008

(65) Prior Publication Data

US 2010/0105249 A1 Apr. 29, 2010

(30) Foreign Application Priority Data

Mar. 8, 2007 (SG) ..... 200701728-8

(51) Int. Cl.
*H01R 12/00* (2006.01)

(52) U.S. Cl. ..... 439/79; 439/638

(58) Field of Classification Search ..... 439/79, 439/378, 638, 680

See application file for complete search history.

(56) References Cited

U.S. PATENT DOCUMENTS

| | | | |
|---|---|---|---|
| 6,648,695 | B1 | 11/2003 | Wu |
| 6,762,615 | B2 | 7/2004 | Lee et al. |
| 6,908,330 | B2 | 6/2005 | Garrett et al. |
| 7,238,054 | B2 | 7/2007 | Higeta et al. |
| 2004/0023559 | A1 | 2/2004 | Wu |

FOREIGN PATENT DOCUMENTS

| | | |
|---|---|---|
| JP | 09-097656 | 4/1997 |
| JP | 10-038972 | 2/1998 |
| KR | 20-2000-0015116 | 3/2000 |
| KR | 10-2002-0072446 | 9/2002 |

*Primary Examiner* — Khiem Nguyen

(74) *Attorney, Agent, or Firm* — Johannes P. M. Kusters; Melanie G. Gover

(57) ABSTRACT

An electrical connector for coupling two electrical connectors is described, the electrical connector configured to couple with a first complementary connector by means of a tongue portion and a pair of end walls, the tongue portion comprising first, second and third tongue sections; a plurality of contacts positioned in the connector housing; and wherein the contacts are grouped into first set and second sets of contacts positioned in the first and second tongue sections respectively. In another embodiment, the contacts are grouped into first, second and third sets of contacts positioned in the first, second and third tongue sections respectively. In another embodiment, an interconnect system having at least one electrical connector coupled to two electrical connectors is described.

20 Claims, 13 Drawing Sheets

CONNECTOR APPARATUS

CROSS REFERENCE TO RELATED APPLICATIONS

This application is a national stage filing under 35 U.S.C. 371 of PCT/US2008/055814, filed Mar. 4, 2008, which claims priority to Singapore Application No. 200701728-8, filed Mar. 8, 2007, the disclosure of which is incorporated by reference in its/their entirety herein.

TECHNICAL FIELD

The present invention relates to a connector and in particular to an electrical connector for coupling two electrical connectors.

BACKGROUND

Hard disk drives (HDDs) are used to store digital data content for laptops, desktop computers, servers and other electronic devices in use today. Each of these electronic devices has its own requirements for the storage media to be used such as access time, capacity, form factor, reliability, and data throughput. Throughput represents the amount of data that a HDD can deliver at any given moment. The throughput is usually measured in bit(s) per second (bps).

Every HDD interface communicates with the rest of the computer via the computer input/output (I/O) bus. The interface is the communication channel over which the data flows as the data is read from or written to the HDD. There are many types of HDD interface and they include Integrated Drive Electronics (IDE), Advanced Technology Attachment (ATA), Small Computer System Interface (SCSI), Serial ATA (SATA), Serial Attached SCSI (SAS), and Fibre Channel. Bridge circuitry is sometimes used to connect HDDs to buses that they cannot communicate with natively, such as IEEE 1394 and Universal Serial Bus (USB). The list of HDD interfaces described in this section is not exhaustive and is constantly increasing to keep pace with the ever changing demands of the electronic devices which dictate the specifications of the HDDs and their interfaces. The interface can be a bottleneck to the overall performance of the electronic device if it cannot support the HDD's maximum throughput.

The SATA connector and the SAS connector are the two most commonly used connectors in the HDD industry today. The SATA headers are often used on HDDs that are fitted with laptops and desktop computers while the SAS headers are used on HDDs fitted with enterprise server systems.

Available in the market today are specialized production test equipment for the testing of HDDs before they are released for sale. However, most of these test equipments are designed specifically for HDDs with a particular type of interface.

It would be desirable to provide an electrical connector that can be used for the testing of a HDD regardless of whether the HDD is fitted with a SATA header or a SAS header. It would be desirable if the electrical connector can further couple with the existing SAS socket thereby allowing the existing SAS socket to be used on the backplane of the printed circuit board (PCB) for the production test equipment. Additionally, it would also be desirable if the electrical connector can be easily modified to serve its purpose of connecting two other connectors as the HDD interface technology continues to evolve.

SUMMARY

In accordance with one embodiment there is provided an electrical connector for coupling two electrical connectors, comprising:

an elongated insulative housing comprising a longitudinal base portion, having a first mating surface and a second mating surface;

wherein the first mating surface is configured to couple with a second complementary connector by means of a central slot defined between a first side wall, a second side wall and a pair of end walls, all walls extending from the base portion;

wherein the second mating surface is configured to couple with a first complementary connector by means of a tongue portion and a pair of end walls, both the tongue portion and the end walls extending from the base portion, the tongue portion comprising a first tongue section, a second tongue section and a third tongue section; and a plurality of contacts positioned in the housing; wherein the contacts are grouped into a first set and a second set of contacts positioned in the first tongue and the second tongue sections respectively.

In accordance with another embodiment there is provided an interconnect system having at least one electrical connector for coupling two electrical connectors, said electrical connector comprising:

an elongated insulative housing comprising a longitudinal base portion, having a first mating surface and a second mating surface;

wherein the first mating surface is configured to couple with a second complementary connector by means of a central slot defined between a first side wall, a second side wall and a pair of end walls, all walls extending from the base portion;

wherein the second mating surface is configured to couple with a first complementary connector by means of a tongue portion and a pair of end walls, both the tongue portion and the end walls extending from the base portion, the tongue portion comprising a first tongue section, a second tongue section and a third tongue section;

a plurality of contacts positioned in the housing; wherein the contacts are grouped into a first set and a second set of contacts positioned in the first tongue and the second tongue sections respectively; and wherein one or both of a first complementary connector and a second complementary connector is coupled to the electrical connector.

In accordance with another embodiment there is an electrical connector for coupling two electrical connectors, comprising:

an elongated insulative housing comprising a longitudinal base portion having a first mating surface and a second mating surface;

wherein the first mating surface is configured to couple with a second complementary connector by means of a central slot defined between a first side wall, a second side wall and a pair of end walls, all walls extending from the base portion;

wherein the second mating surface is configured to couple with a first complementary connector by means of a tongue portion and a pair of end walls, both the tongue portion and the end walls extending from the base portion, the tongue portion comprising a first tongue section, a second tongue section and a third tongue section; and a plurality of contacts positioned in the housing; wherein the contacts are grouped into a first set, a second set and a third set of contacts positioned in the first tongue, the second tongue and the third tongue sections respectively.

In accordance with another embodiment there is provided an interconnect system having at least one electrical connector for coupling two electrical connectors, said electrical connector comprising:

an elongated insulative housing comprising a longitudinal base portion having a first mating surface and a second mating surface;

wherein the first mating surface is configured to couple with a second complementary connector by means of a central slot defined between a first side wall, a second side wall and a pair of end walls, all walls extending from the base portion;

wherein the second mating surface is configured to couple with a first complementary connector by means of a tongue portion and a pair of end walls, both the tongue portion and the end walls extending from the base portion, the tongue portion comprising a first tongue section, a second tongue section and a third tongue section; and a plurality of contacts positioned in the housing; wherein the contacts are grouped into a first set, a second set and a third set of contacts positioned in the first tongue, the second tongue and the third tongue sections respectively; and wherein one or both of a first complementary connector and a second complementary connector is coupled to the electrical connector.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

An exemplary form of the present invention will now be described with reference to the accompanying drawings in which.

DETAILED DESCRIPTION

The SATA connector and the SAS connector are the two most commonly used connectors in the HDD industry today. The SATA headers are often used on HDDs that are fitted with laptops and desktop computers while the SAS headers are used on HDDs fitted with enterprise server systems. The SATA interface comprises one segment with 7 pins (contacts) used for the transmission of data signals and another segment with 15 pins (contacts) used for the conduction of electrical power, both segments having a pitch of 1.27 mm (0.05"). For the SAS interface, in addition to the two segments mentioned earlier, there is one more segment with 7 pins having a pitch of 0.80 mm (0.03") used for the transmission of data signals.

Available in the market today are specialized production test equipment for the testing of HDDs before they are released for sale. However, most of these test equipments are designed specifically for HDDs with a particular type of interface such as SATA.

Figure 1:
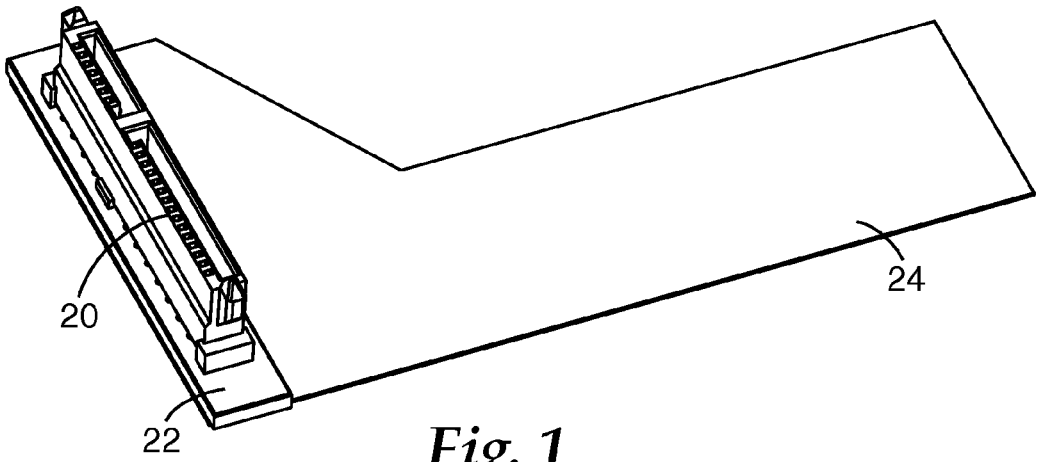
FIG. 1 shows an example of a SATA socket soldered on a rigid PCB that is bonded to a flexible PCB.

FIG. 1 shows an example of a SATA socket 20 soldered on a rigid PCB 22 that is bonded to a flexible PCB 24. The flexible PCB 24 will be coupled to a production test equipment via another connector (not shown) when in use. A SATA header (not shown) on a PCB of a HDD-to-be-tested is plugged into the SATA socket 20 on the rigid PCB 22 before the test sequences on the production test equipment which the flexible PCB 24 is coupled to are executed. The SATA header on the PCB of the HDD that is tested is unplugged from the SATA socket 20 on the rigid PCB 22 after the tests are completed. Each plugging and unplugging of the SATA header to and from the SATA socket 20 is known as a mating cycle. The performance of the SATA socket 20 on the rigid PCB 22 drops with repeated mating. The SATA socket 20 on the rigid PCB 22 is replaced as soon as the number of mating cycles reaches the number specified by the manufacturer of the SATA socket 20. To replace the SATA socket 20 on the rigid PCB 22, one has to de-solder the existing SATA socket 20 from the rigid PCB 22 and then re-solder a new SATA socket 20 to the rigid PCB 22 before both rigid PCB 22 and flexible PCB 24 can be re-used with the production test equipment for testing HDDs. This is time consuming and repeated de-soldering and re-soldering of the SATA socket 20 from and to the rigid PCB 22 may damage the rigid PCB 22.

An alternative solution is to couple an interface socket to a backplane PCB of a production test equipment and then use a sacrificial connector to couple a header on a PCB of a HDD to the interface socket on the backplane PCB of the production test equipment. The sacrificial connector should have a socket that is able to accept the interface of the header coupled on the PCB of the HDD.

Figure 2A:
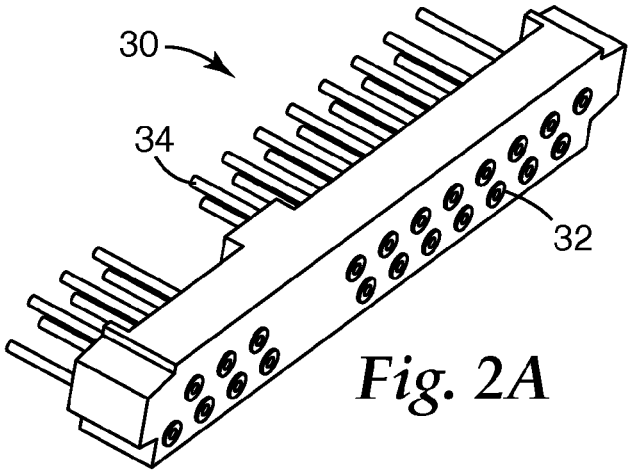
FIG. 2A shows an example of an interface socket used for coupling a sacrificial SATA socket to a backplane PCB.
Figure 2B:
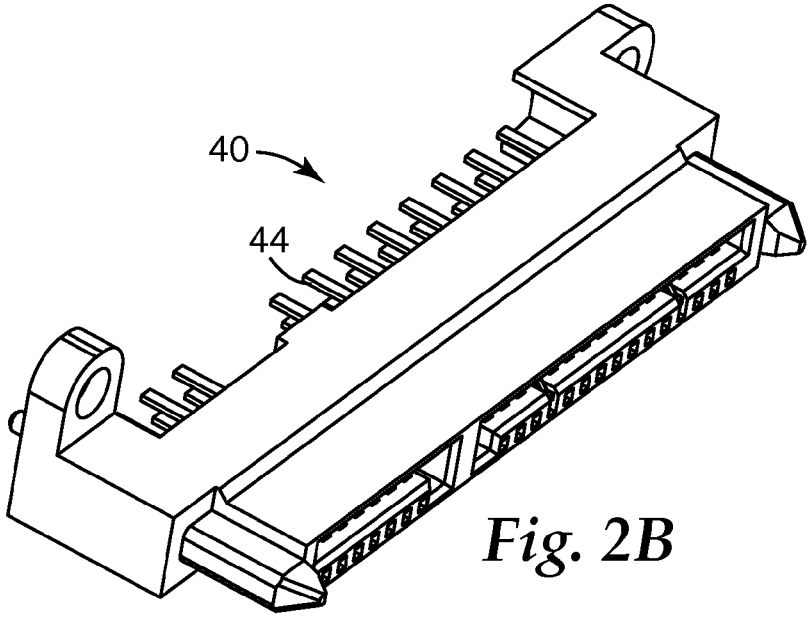
FIG. 2B shows an example of a sacrificial SATA socket.
Figure 2C:
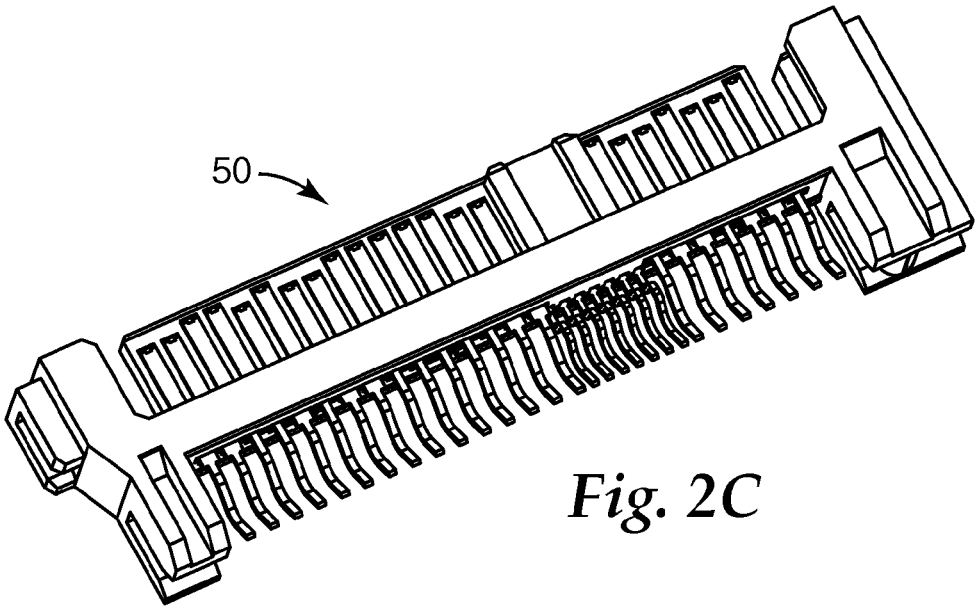
FIG. 2C shows an example of a SATA header on a PCB for a HDD used for coupling to a sacrificial SATA socket.

FIG. 2A shows an example of an interface socket 30 used for coupling a sacrificial SATA connector to a backplane PCB. FIG. 2B shows an example of a sacrificial SATA connector 40 specially designed to be used with the interface socket 30. FIG. 2C shows an example of a SATA header 50 used on a PCB of a HDD that can couple to the sacrificial SATA connector 40.

Figure 3:
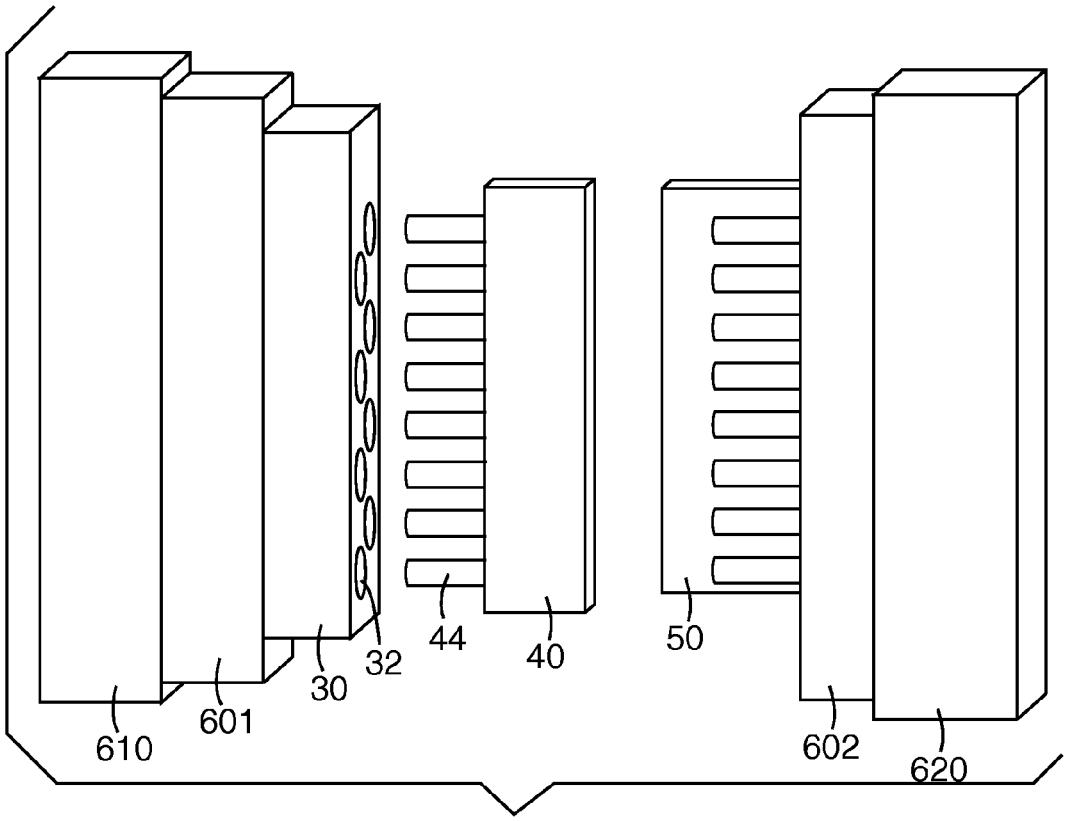
FIG. 3 shows a diagrammatic representation of how a sacrificial SATA socket is coupled to an interface socket on the backplane PCB and a SATA header on the PCB of a HDD.

FIG. 3 shows a diagrammatic representation of how a sacrificial SATA connector 40 is coupled to an interface socket 30 on a backplane PCB 601 of a production test equipment 610 and a SATA header 50 on a PCB 602 of a HDD 620. The interface socket 30 has a plurality of socket holes 32 on a first major side to accept a plurality of long tails 44 of the sacrificial SATA connector 40 to be coupled. On a second major side of the interface socket 30, there is a plurality of long tails (not shown) corresponding to the positions of the socket holes 32 on the first major side, the long tails on the second major side are used for bonding the interface socket 30 to the backplane PCB 601 of the production test equipment 610.

With this arrangement, the SATA header 50 on the PCB 602 of the HDD 620 mates with the sacrificial SATA connector 40 instead of mating directly with the interface socket 30 that is bonded to the backplane PCB 601 of the production test equipment 610. Therefore, it takes a longer period of use before there is a need to replace the interface socket 30 on the backplane PCB 601. The sacrificial SATA connector 40 is replaced as soon as the usage reaches the number of maximum mating cycles specified by the manufacturer of the sacrificial SATA connector 40. As the sacrificial SATA connector 40 is temporarily bonded to the interface socket 30, there is less damage to the interface socket 30 when the sacrificial SATA connector 40 is replaced. And since it takes a longer period of use before the interface socket 30 has to be replaced, the lifespan of the backplane PCB 601 can be increased.

The above design works only if the header on the PCB of the HDD-to-be-tested is of the SATA interface. The production test equipment 610 with the interface socket 30 cannot be used to test a HDD with a SAS header on its PCB unless the sacrificial SATA connector 40 is replaced with a similar sacrificial connector that has a SAS socket. At the same time, the interface socket and the backplane PCB of the production test equipment will need to be redesigned to accept the additional seven long tails of the sacrificial SAS connector corresponding to the additional segment in the SAS interface used for the transmission of data signals.

As previously highlighted, the additional segment on the SAS interface is of a smaller pitch (0.80 mm or 0.03") compared to the two segments on the SATA interface (1.27 mm or 0.05"). This reduced pitch poses additional challenges to the manufacture of the additional seven long tails in the sacrificial SAS connector.

The need to redesign the backplane PCB, the interface socket and the sacrificial connector coupled with the need to have a dedicated production test equipment for testing HDDs with SATA headers and another production test equipment for testing HDDs with SAS headers, increase the manufacturing costs for HDD manufacturers.

A solution to the above problem is to have a sacrificial connector that can be used for the testing of both the SATA and SAS HDDs using the same production test equipment without a need for a major redesign to the existing backplane PCB of the production test equipment. It will also be useful if the sacrificial connector has a header that can couple with a commonly available SAS interface socket on the backplane PCB instead of having long tails on the sacrificial connector which then require an interface socket that has holes specially designed to match the long tails on the sacrificial connector.

An exemplary electrical connector 100 of the present invention is a sacrificial connector that can be used for the testing of both the SATA and SAS HDDs. In addition, the electrical connector 100 will mate with a commonly available SAS interface socket thereby minimizing the amount of design changes needed on the backplane PCB of the production test equipment.

With reference to FIGS. 4A, 4B, 5, 6A, 6B and 9, the exemplary electrical connector 100 of the present invention comprises an elongated, insulative housing 110 with a longitudinal base portion 115 and a plurality of first set, second set and third set of contacts 310, 320, 330 received in the housing 110. The housing 110 forms a first mating surface 160 and a second mating surface 165.

At the first mating surface 160, a first side wall 120, a second side wall 122 and a pair of end walls 124, 126 extend from the base portion 115. A central receiving slot 130 is defined between the longitudinally extending side walls 120, 122 and the laterally extending end walls 124, 126 for engaging with a second complementary connector 48 at the first mating surface 160. In at least one embodiment, the second complementary connector 48 is a SATA header. In at least one other embodiment, the second complementary connector 48 is a SAS header.

The first side wall 120 has a recess 132 recessed from an inner face thereof which divides the first side wall 120 into a first mating section 1601 and a second mating section 1602. The first mating section 1601 of the first side wall 120 is longer than the second mating section 1602. The second side wall 122 has a third mating section 1603 at a position opposing to the recess 132 of the first side wall 120.

A pair of guiding posts 146 protrude from the base portion 115 and next to the respective end walls 124, 126. Each guiding post 146 forms a tapered guiding portion 1461 extending beyond the first mating surface 160 of the housing 110 for guiding an insertion of a second complementary connector 48.

At the second mating surface 165, a tongue portion 200 and a pair of opposite end walls 210 extend from the base portion 115. Each end wall 210 has a guiding space 143 for guiding the insertion of the first complementary connector 45. The tongue portion 200 includes opposite first and second surfaces 201, 202 and forms a first tongue section 221 adjacent to one end wall 210, a second tongue section 222 adjacent to the other end wall 210, and a third tongue section 223 between the first and the second tongue sections 221, 222. The first and second tongue sections 221, 222 have a plurality of passages 240 in the first surface 201 of the tongue portion 200 and the third tongue section 223 has a plurality of passages 240 in the second surface 202 of the tongue portion 200. In at least one embodiment, the first complementary connector 45 is a SAS socket.

The first, the second and the third mating sections 1601, 1602, 1603 at the first mating surface 160 each has a plurality of passageways 245 that extends from the first mating surface 160 to the second mating surface 165 and respectively communicate with the corresponding passages 240 in the tongue portion 200. The passageways 245 in the first and the second mating sections 1601, 1602 are arranged in a same row. The passageways 245 in the third mating section 1603 are arranged in another row and this row is located lower than the row for the first and the second mating sections 1601, 1602.

Figure 5:
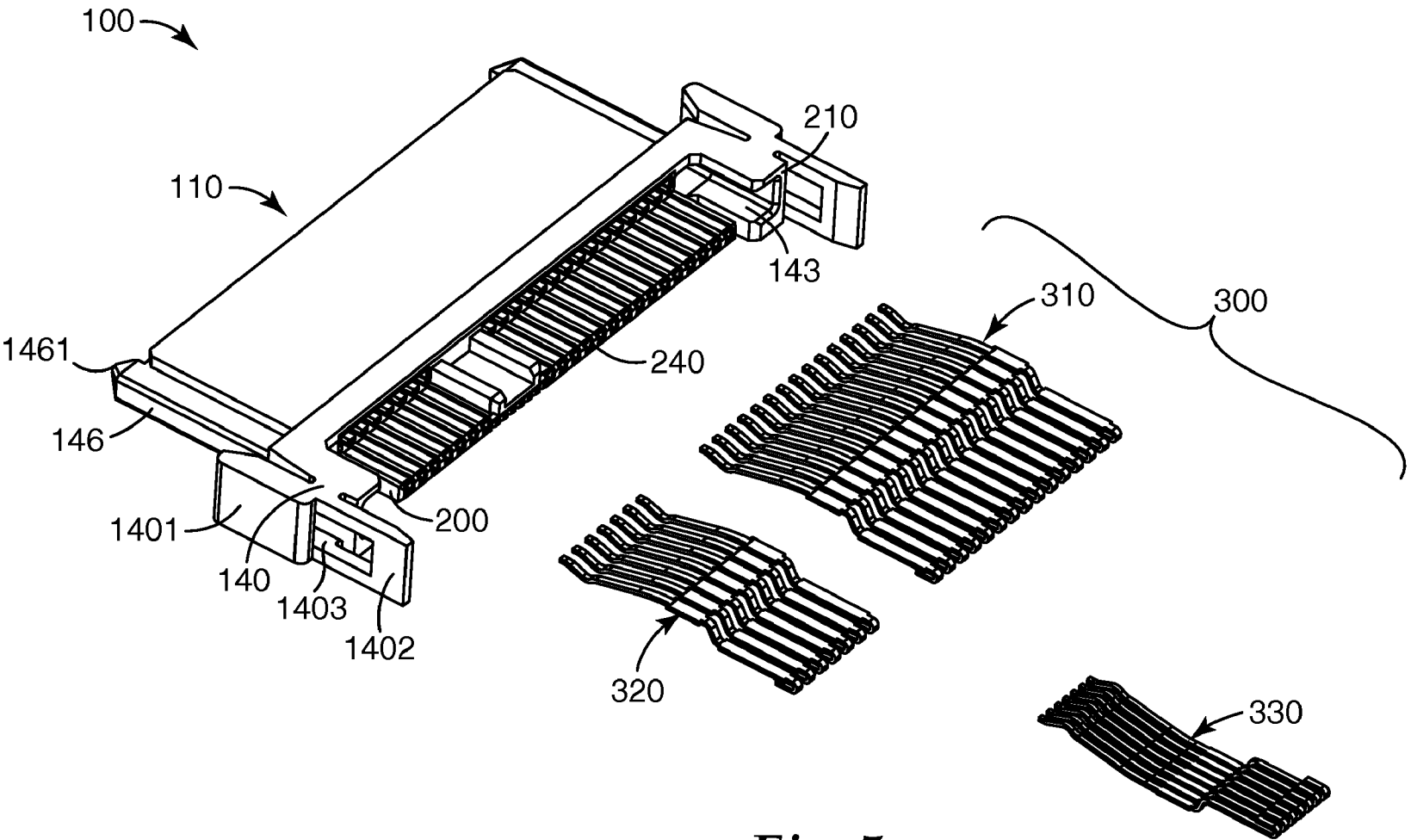
FIG. 5 is a perspective view of the exemplary connector of the present invention and the contacts which will be inserted into the exemplary connector of the present invention.
Figure 6A:
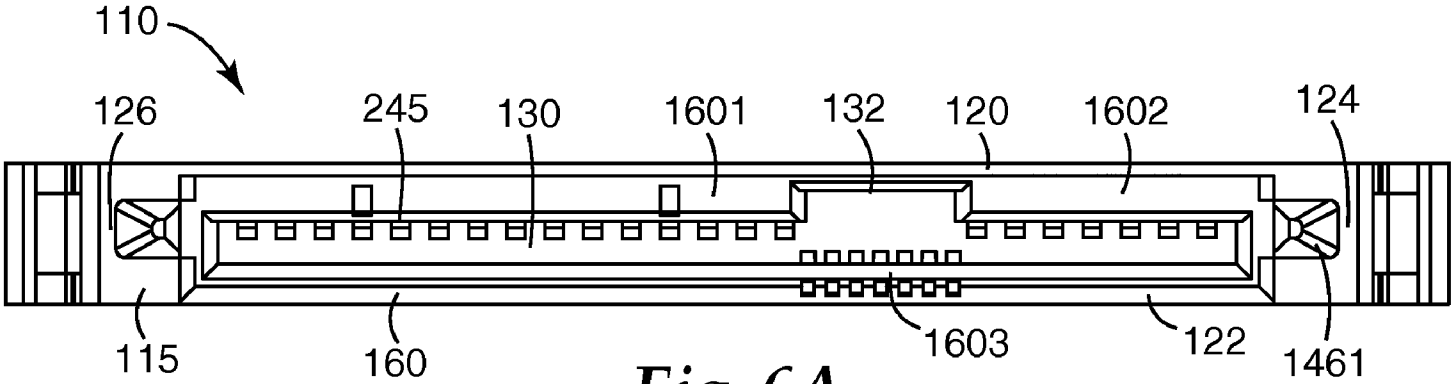
FIG. 6A is a perspective view of the exemplary connector of the present invention viewed from the first mating surface.
Figure 6B:
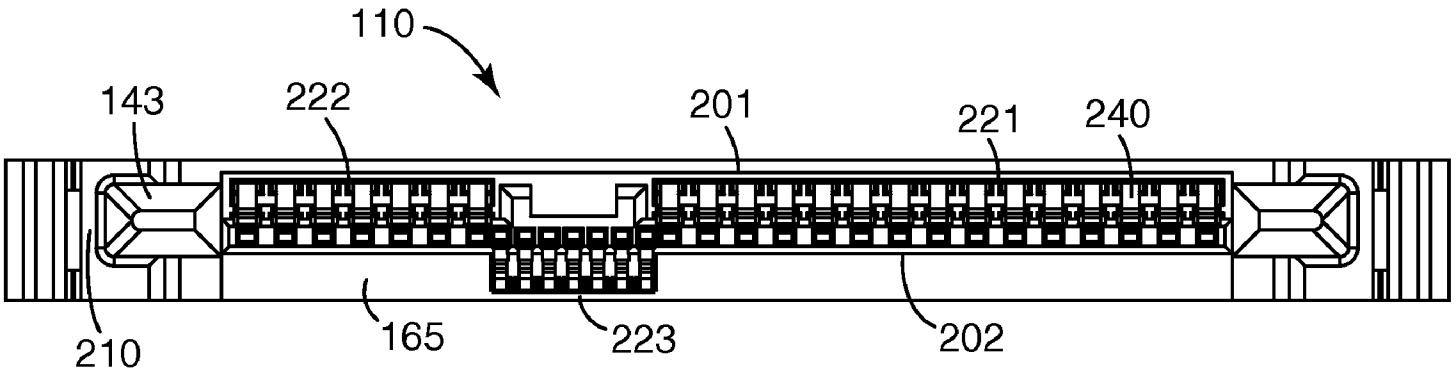
FIG. 6B is a perspective view of the exemplary connector of the present invention viewed from the second mating surface.
Figure 7:
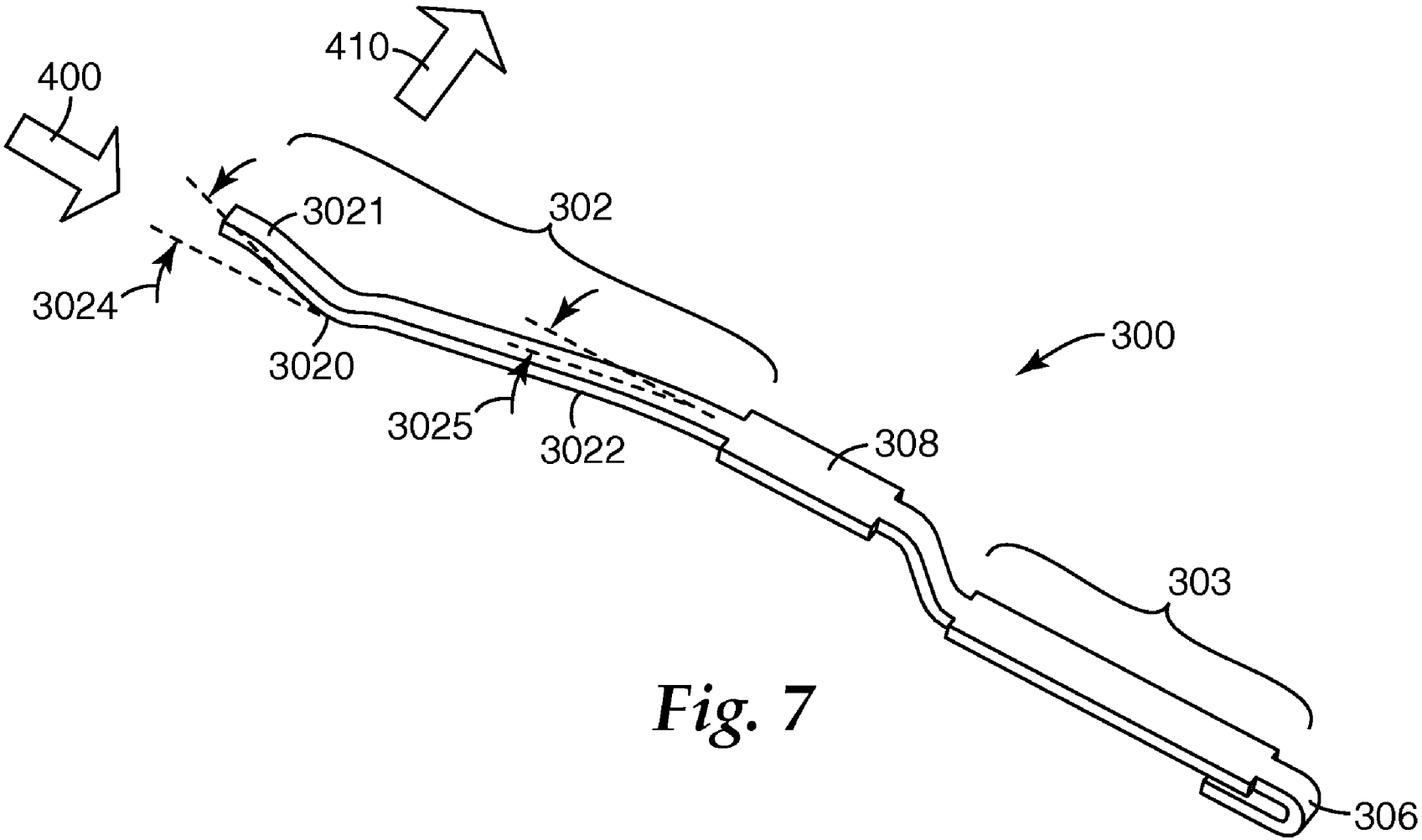
FIG. 7 is a perspective view of the different parts of a contact located in the exemplary connector of the present invention.
Figure 8:
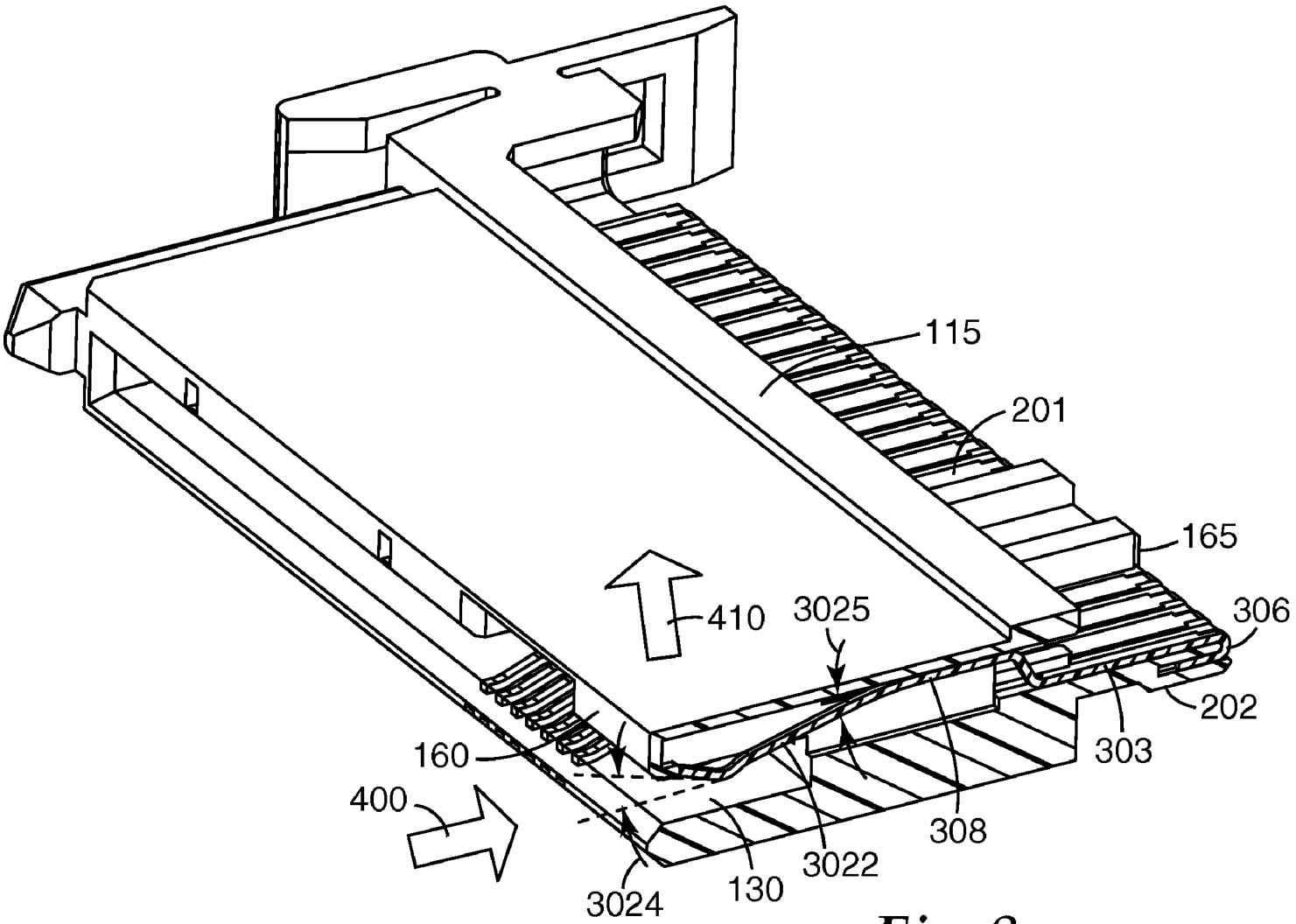
FIG. 8 is a cross-sectional view of the exemplary connector of the present invention with one contact exposed.
Figure 9:
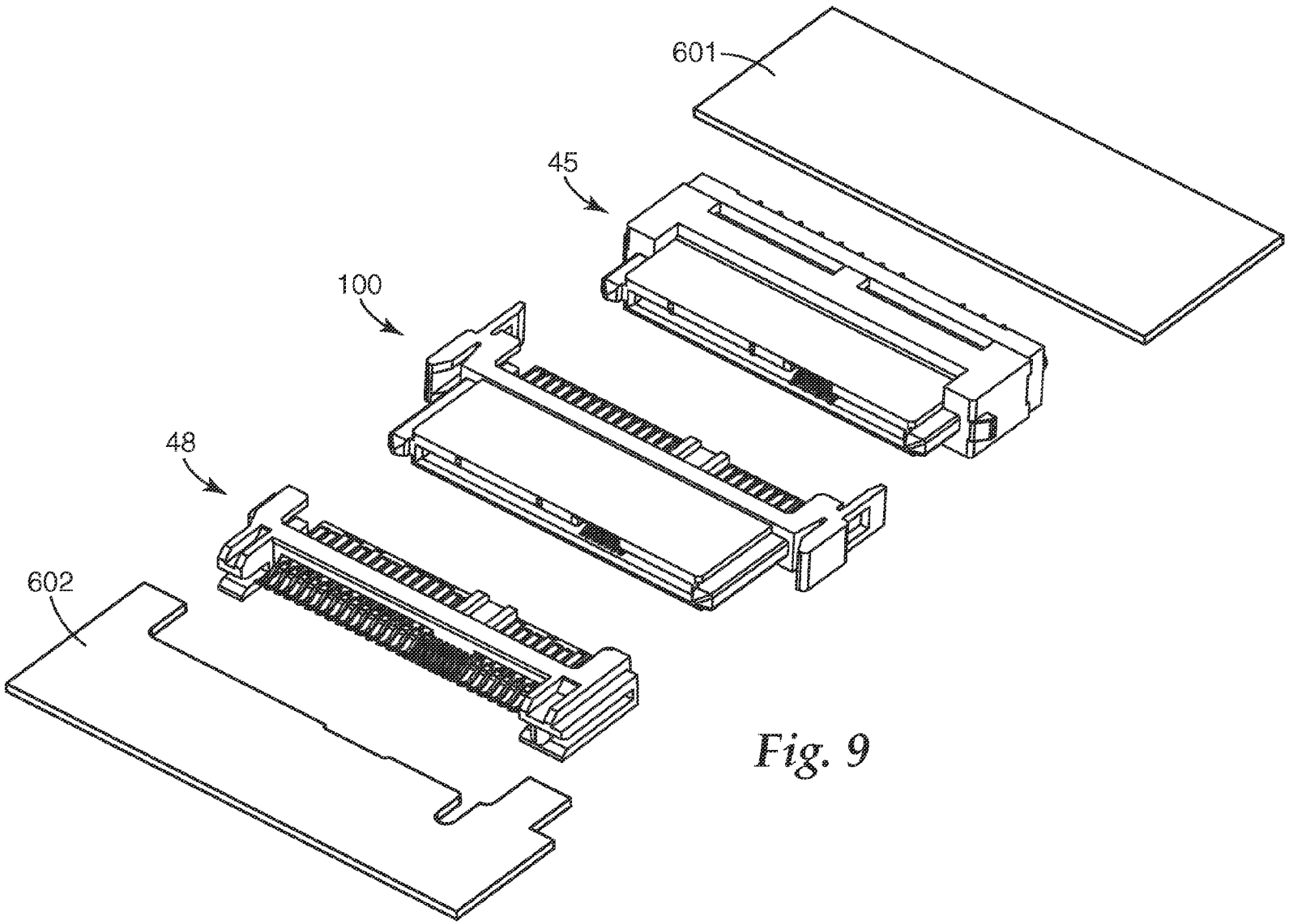
FIG. 9 is a perspective view of the exemplary connector of the present invention in relation to a first complementary connector that is intended to be coupled to a backplane PCB of a production test equipment and to a second complementary connector that is intended to be coupled to a PCB which is further coupled to a data storage device.

Referring to FIG. 5 in conjunction with FIGS. 7 to 9, the contacts 300 include a set of first set of contacts 310 mainly for power transmission, a second set and a third set of contacts 320, 330 both for signal transmission.

The first set, second set and third set of contacts 310, 320, 330 respectively protrude through the passageways 245 of the first, second and third mating sections 1601, 1602, 1603 and are received in the corresponding passages 240 of the tongue portion 200. The three sets of contacts 300 are substantially identical in structure, and only one of the contacts 300 is illustrated here for simplicity.

Each contact 300 comprises a first contact portion 302 which will reside at central receiving slot 130 of the housing 110, a second contact portion 303 which will reside at tongue portion 200 of the housing 110, and a housing retaining portion 308 interconnecting the first contact portion 302 and the second contact portion 303.

In the design of the first contact portion 302 of the contact 300 at the first mating surface 160, one has to take into consideration the desired insertion and normal forces 400, 410 permissible for the second complementary connector 48. In order for the electrical connector 100 to be able to withstand a higher number of mating cycles, the insertion and normal forces 400, 410 have to be kept to a minimum.

In one embodiment of the present invention, the first contact portion 302 may be a cantilever beam structure which comprises a first part 3021 of the first contact portion 302, a second part 3022 of the first contact portion 302 and a kink 3020 separating the first part 3021 and the second part 3022. As illustrated in FIG. 7, the first part 3021 of the first contact portion 302 is inclined at a first angle 3024 to the horizontal position while the second part 3022 of the first contact portion 302 is inclined at a second angle 3025 to the horizontal position. This cantilever beam design forms a convex contact end exposed in the central receiving slot 130 of the housing 110 for electrically engaging with a corresponding terminal of the second complementary connector 48 at the first mating surface 160. Preferably the first angle 3024 is of a value of about less than 20 degrees and the second angle 3025 is of a value of about 20 degrees to 25 degrees.

The second contact portion 303 has a flat shape and is exposed in the corresponding passage 240 of the tongue portion 200 of the housing 110 for electrically engaging with a corresponding terminal of the first complementary connector 45 at the second mating surface 165. The second contact portion 303 may be bonded to the housing 110 by incorporating a 'U' hook structure 306 at the second mating surface 165 to prevent the second contact portion 303 from lifting away from the housing 110 as a result of repeated mating with the first complementary connector 45. Other methods of bonding the second contact portion 303 to the housing 110 may be adopted and are within the scope of the invention. The housing retaining portion 308 provides a barb on a lateral edge for interfering within the housing 110.

Conventional electrical connectors are able to withstand a minimum of 500 mating cycles to about 5,000 mating cycles. The exemplary electrical connector 100 of the present invention is able to withstand a minimum of 5,000 mating cycles to about 10,000 mating cycles. Different materials such as phosphor bronze or beryllium copper with nickel and gold plating, or other types of copper alloys with the equivalent metal plating, may be used to manufacture the contacts 300. The design of the contacts 300 as well as the choice of material used for the contacts 300 will determine the maximum limit of mating cycles for the electrical connector 100.

In another embodiment of the present invention, the electrical connector 100 may further comprise a bonding device 140 coupled to at least one end wall 210. The bonding device 140 may be any device that is able to temporarily hold the electrical connector 100 in place with respect to the first complementary connector 45 at the second mating surface 165 as the second complementary connector 48 connects and disconnects to and from the electrical connector 100 at the first mating surface 160 during each mating cycle. The bonding device 140 may be integrally assembled with the housing 110 and should enable the electrical connector 100 to be easily de-coupled from the first complementary connector 45 as and when there is a need to remove the electrical connector 100 from the first complementary connector 45 or replace the electrical connector 100 with another electrical connector 100.

Figure 4A:
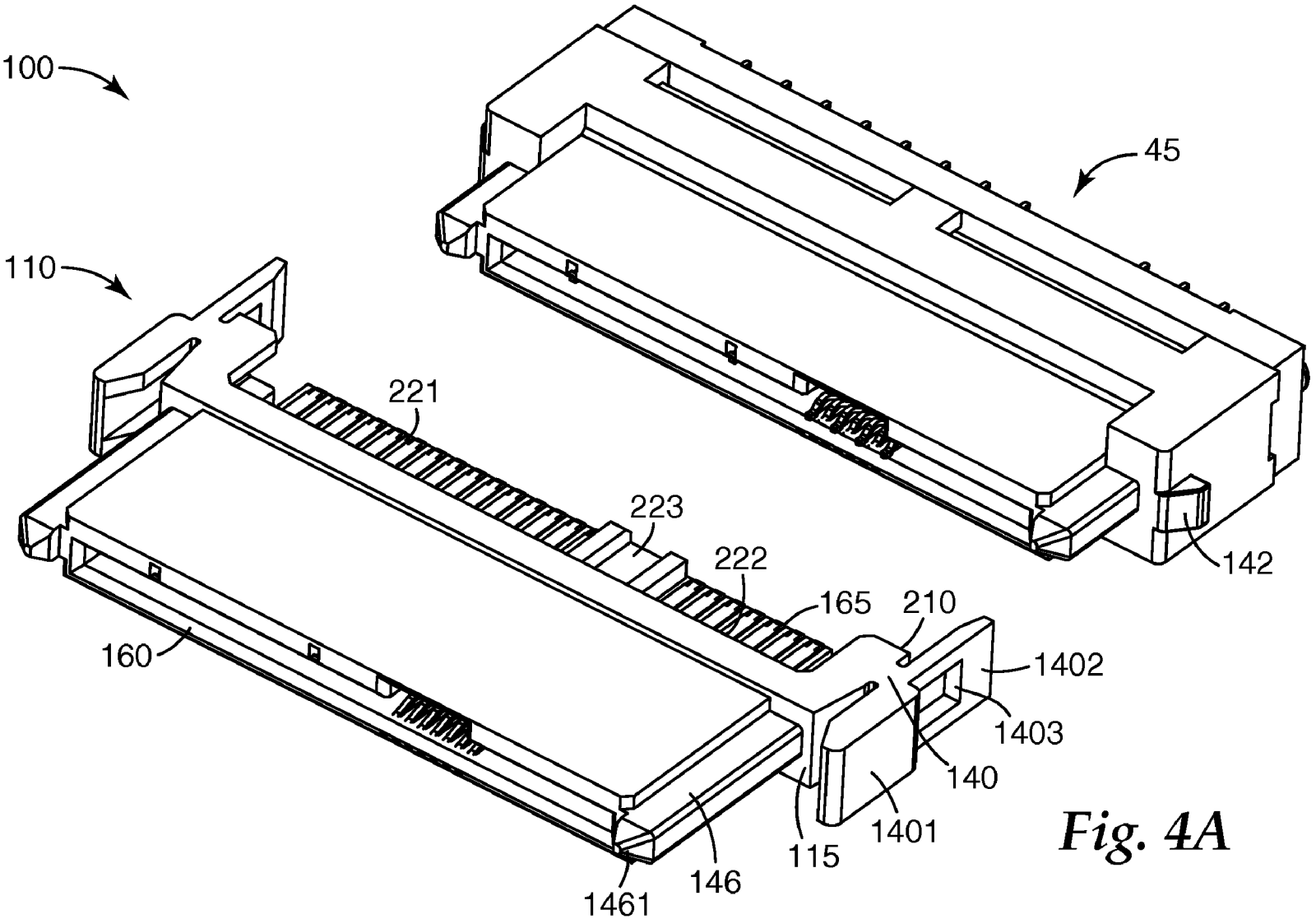
FIG. 4A is a perspective view of an exemplary connector of the present invention in relation to a complementary connector that is intended to be coupled to a backplane PCB of a production test equipment.
Figure 4B:
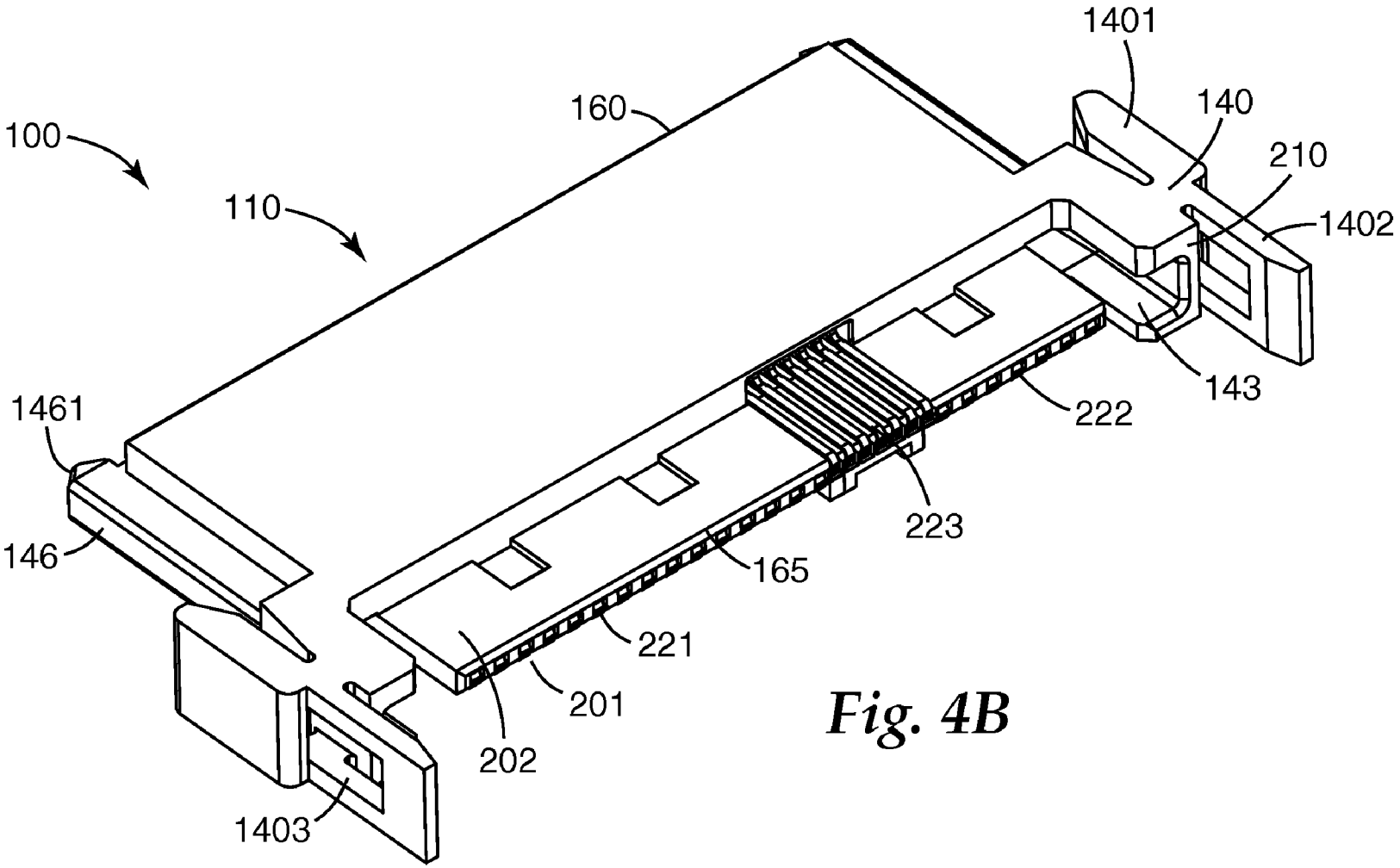
FIG. 4B is a perspective view of the exemplary connector of the present invention viewed from the second surface of the connector.

In another embodiment of the present invention, the bonding device 140 is a latching device with a latch release 1401, a latch member 1402 extending in the direction of the second mating surface 165 and a hole 1403 in the latch member 1402. With reference to FIG. 4A, as the electrical connector 100 mates with the first complementary connector 45 at the second mating surface 165, a protrusion 142 coupled to an end wall on the first complementary connector 45 pushes the latch member 1402 outwards away from the end wall of the first complementary connector 45 as the latch member 1402 rides over the slope of protrusion 142. As the latch member 1402 passes the ridge of the protrusion 142, the hole 1403 in the latch member 1402 engages with the protrusion 142 of the complementary connector 45 causing the latch member 1402 to fall back to its original horizontal position. This is the locked position of the latching device and the electrical connector 100 is firmly coupled to the first complementary connector 45.

To de-couple the electrical connector 100 from the first complementary connector 45, the latch release 1401 is depressed inwards towards the housing 110 of the electrical connector 100. In doing so, the hole 1403 in the latch member 1402 disengages with the protrusion 142 on the first complementary connector 45, and the two connectors 100, 45 can be easily de-coupled by pulling the electrical connector 100 in a direction away from the first complementary connector 45.

It is preferable that the electrical connector 100 has a bonding device 140 at each end wall 210 so that the electrical connector 100 can be properly aligned to the first complementary connector 45 when they are coupled. Accordingly, there should be a protrusion at each end wall of the first complementary connector 45. In another embodiment of the present invention, the bonding device 140 may be cantilevered and may be made of sheet metal.

A new type of HDD interface that is emerging today is the Micro SATA interface. This type of interface is currently targeted at HDDs which have the requirement of small form factor and low power consumption. At this moment, HDDs with this type of HDD interface are used in laptops where the there is limited real estate within the laptops for the HDDs and the power consumption of these HDDs is a concern. Like the SATA interface, the Micro SATA interface comprises one segment for the transmission of data signals and another segment for the conduction of electrical power, both segments having a pitch of 1.27 mm (0.05"). The difference between the SATA interface and the Micro SATA interface is that for the Micro SATA interface, the number of pins (contacts) used for the conduction of electrical power has been reduced from 15 to 9 and the segment allocated for the conduction of electrical power is further divided into 2 smaller segments by a base portion extension. Of the 9 pins (contacts) allocated for the conduction of electrical power, 7 pins (contacts) are in the longer segment and the remaining 2 pins are in the shorter segment.

In another embodiment of the present invention, the electrical connector 2000 is a sacrificial connector that can be used for the testing of the Micro SATA HDDs. In addition, the electrical connector 2000 will mate with both a standard Micro SATA interface socket and a Micro SATA header. The circuitry on the backplane PCB of existing production test equipment may need to be slightly modified to accept the Micro SATA interface socket.

With reference to FIGS. 10A, 10B, 11, 12A and 12B, the exemplary electrical connector 2000 of the present invention comprises an elongated, insulative housing 2110 with a longitudinal base portion 2115 and a plurality of first set, second set and third set of contacts 2310, 2320, 2330, received in the housing 2110. The housing 2110 forms a first mating surface 2160 and a second mating surface 2165.

At the first mating surface 2160, a first side wall 2120, a second side wall 2122 and a pair of end walls 2124, 2126 extend from the base portion 2115. A central receiving slot 2130 is defined between the longitudinally extending side walls 2120, 2122 and the laterally extending end walls 2124, 2126 for engaging with a second complementary connector 2048 at the first mating surface 2160. In at least one embodiment, the second complementary connector 2048 is a Micro SATA header.

The first side wall 2120 has a first base recess and a second base recess 2132, 2134 recessed from an inner face thereof which divides the first side wall 2120 into a first mating section 21601, a second mating section 21602 and a third mating section 21603. The first mating section 21601 of the first side wall 2120 is shorter than the second and the third mating sections 21602, 21603. The second mating section 21602 of the first side wall 2120 may be of the same length as the third mating sections 21603.

A pair of guiding posts 146 protrude from the base portion 2115 and next to the respective end walls 2124, 2126. Each guiding post 146 forms a tapered guiding portion 1461 extending beyond the first mating surface 2160 of the housing 2110 for guiding an insertion of a second complementary connector 2048.

At the second mating surface 2165, a tongue portion 2200 with opposite first and second surfaces 2201, 2202 and a pair of opposite end walls 2210 extend from the base portion 2115. Each end wall 2210 has a guiding space 143 for guiding the insertion of the first complementary connector 2045. The tongue portion 2200 is divided into a first tongue section, a second tongue section and a third tongue section 2221, 2222, 2223 by a first base extension portion 2721 and a second base extension portion 2722 respectively.

Figure 10A:
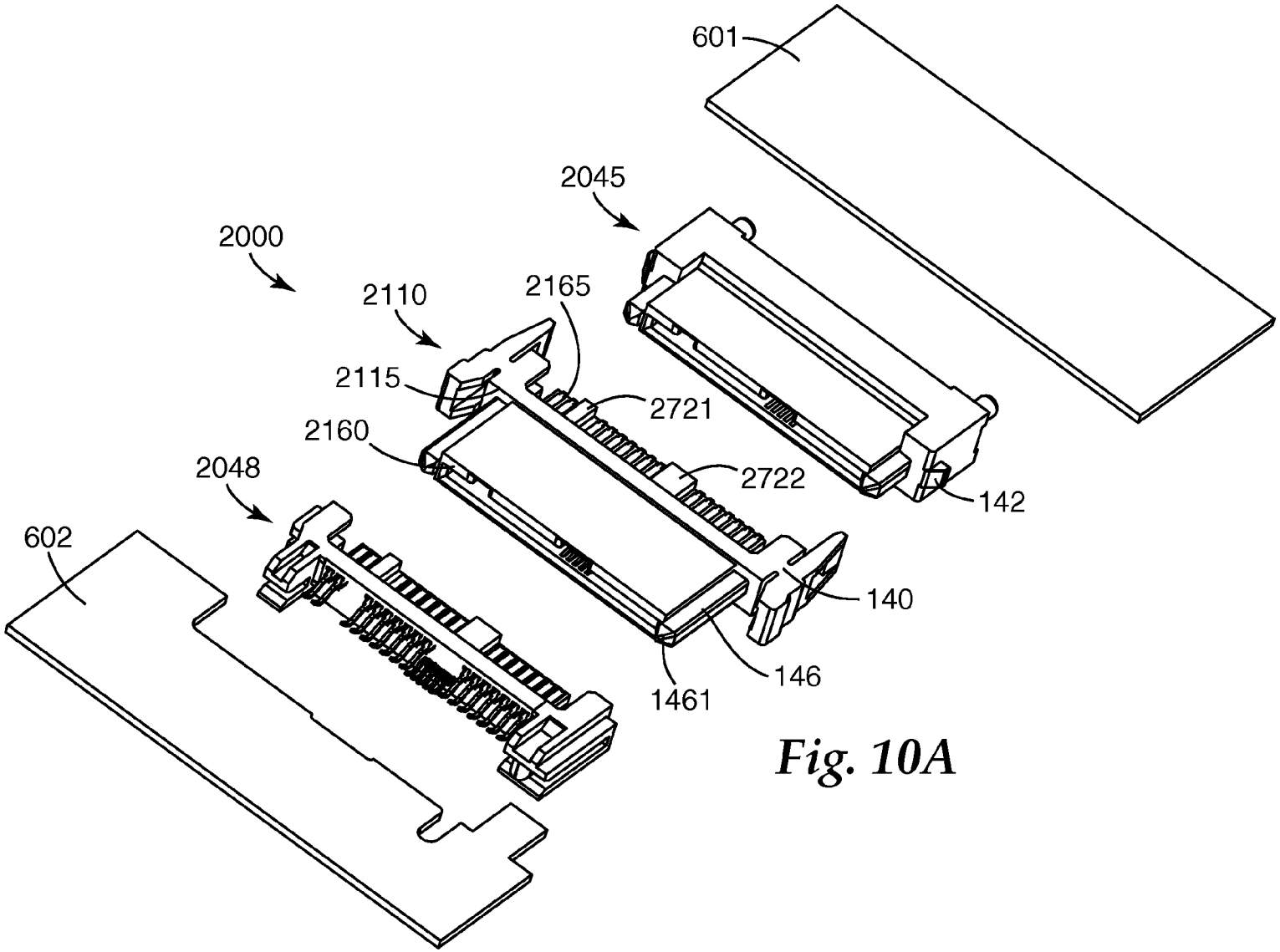
FIG. 10A is a perspective view of one other exemplary connector of the present invention in relation to a complementary connector that is intended to be coupled to a backplane PCB of a production test equipment.
Figure 10B:
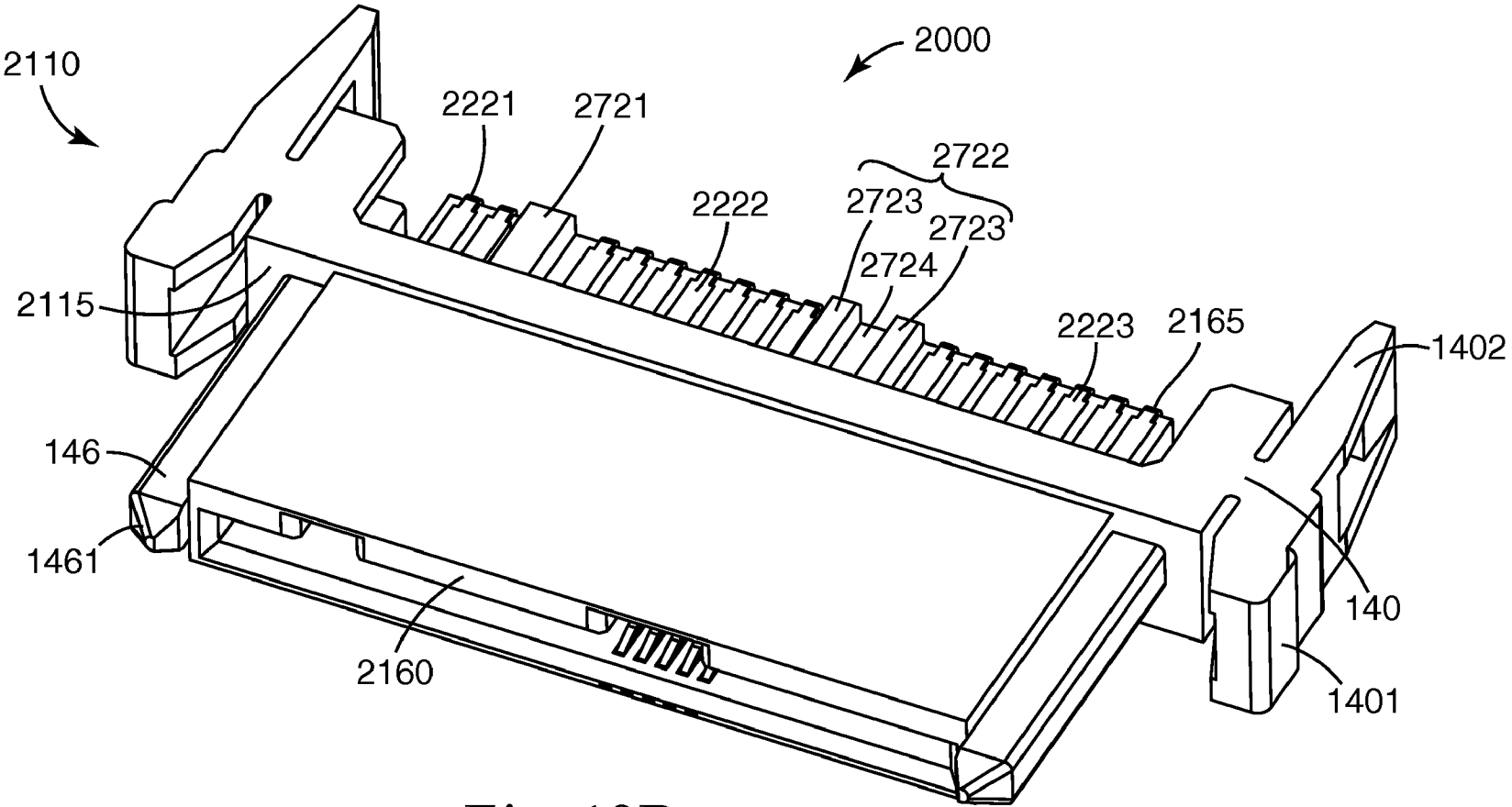
FIG. 10B is a perspective view of the exemplary connector of FIG. 10A with a different base extension portion.

The first base extension portion 2721 is narrower in width than the second base extension portion 2722. The base extension portion may adopt different forms. In FIG. 10A, the first and the second base extension portions 2721, 2722 are solid portions with thickness greater than that of the first, the second and the third tongue sections 2221, 2222, 2223. In FIG. 10B, the second base extension 2722 is a channel defined by two channel side walls 2723 and a channel base 2724 with the thickness of the channel base 2724 being the same as that of the first, the second and the third tongue sections 2221, 2222, 2223.

The first, second and third tongue sections 2221, 2222, 2223 have a plurality of passages 2240 in the first surface 2201 of the tongue portion 2200. The first, the second and the third mating sections 21601, 21602, 21603 at the first mating surface 2160 each has a plurality of passageways 2245 that extends from the first mating surface 2160 to the second mating surface 2165 and respectively communicate with the corresponding passages 2240 in the tongue portion 2200.

Figure 11:
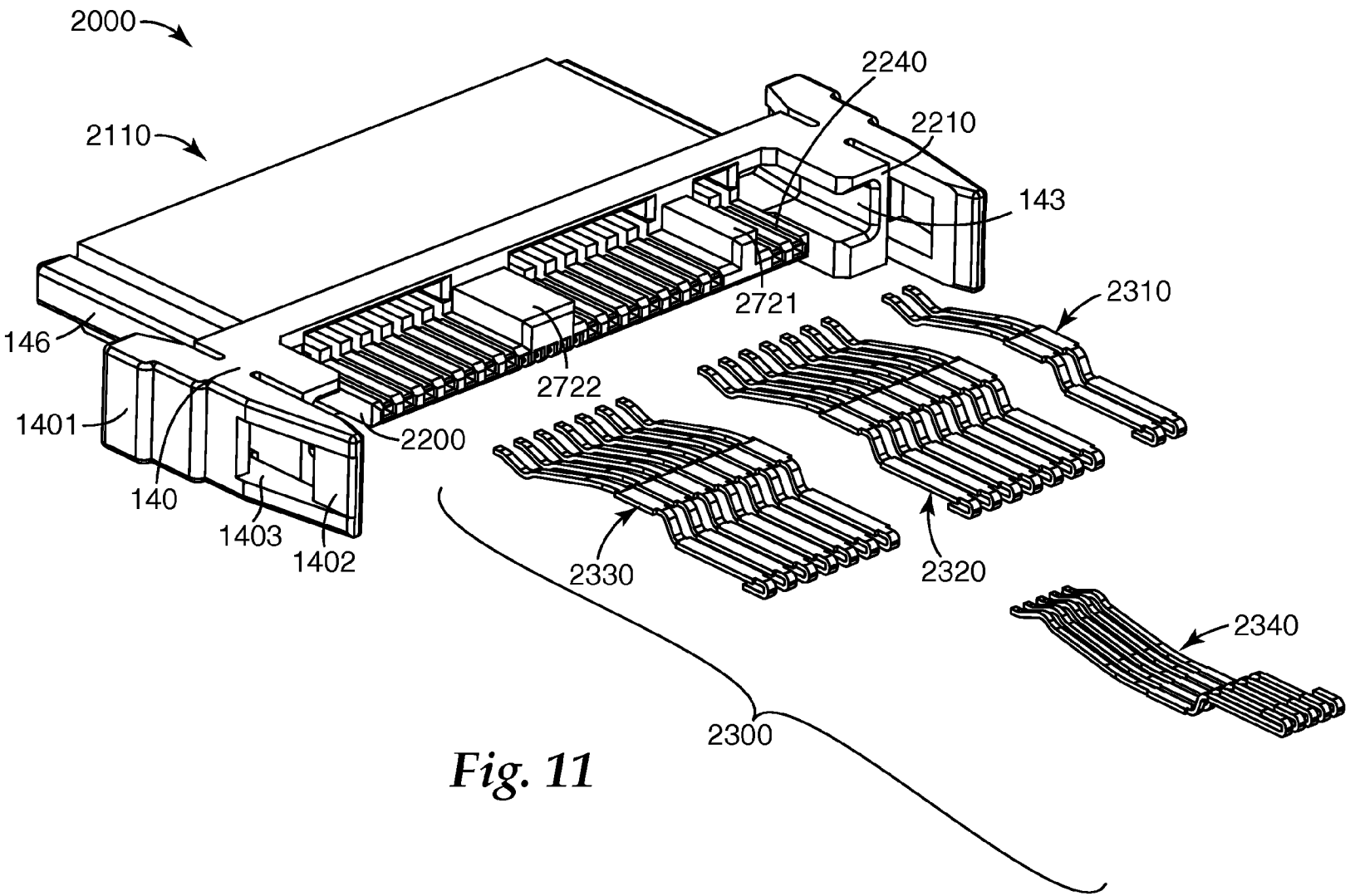
FIG. 11 is a perspective view of the exemplary connector of FIG. 10A and the contacts which will be inserted into the connector.

Referring to FIG. 11, the contacts 2300 include a set of first set and a second set of contacts 2310, 2320 both for power transmission and a third set of contacts 2330 for signal transmission. The first set, second set and third set of contacts 2310, 2320, 2330 respectively protrude through the passageways 2245 of the first, second and third mating sections 21601, 21602, 21603 and are received in the corresponding passages 2240 of the tongue portion 2200. The three sets of contacts 2300 are substantially identical in structure and function to the contacts 300. The material and embodiments described earlier which pertain to the contacts 300 are applicable to the contacts 2300 and are within the scope of the invention.

Figure 12A:
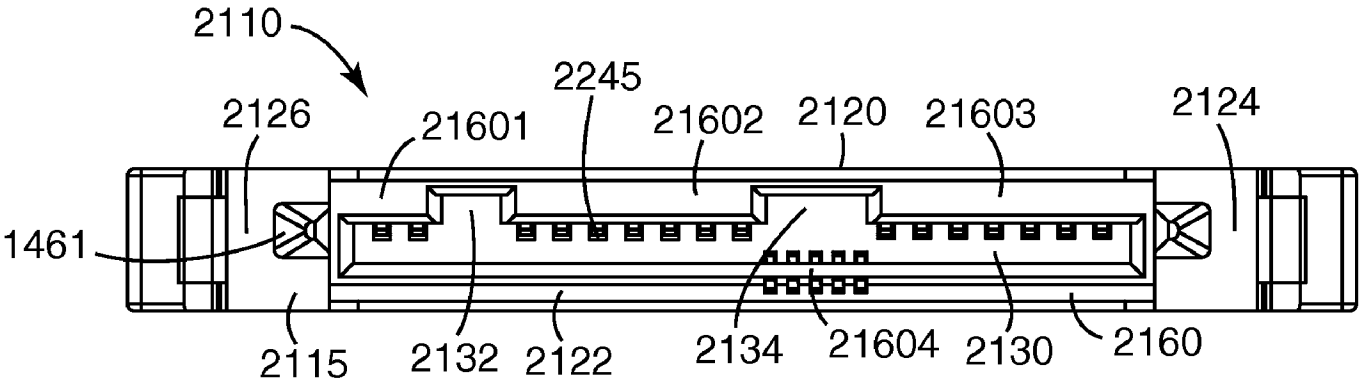
FIG. 12A is a perspective view of the exemplary connector of FIG. 10A viewed from the first mating surface.
Figure 12B:
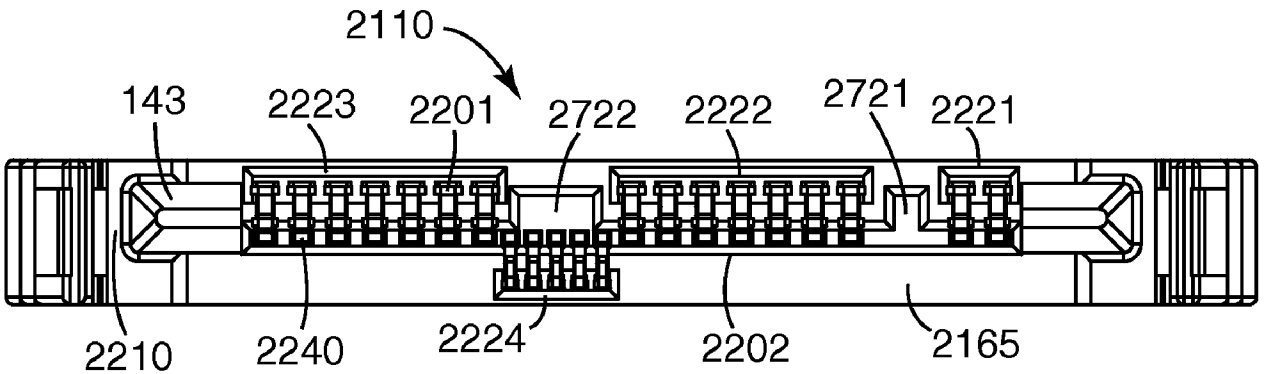
FIG. 12B is a perspective view of the exemplary connector of FIG. 10A viewed from the second mating surface.

Referring to FIGS. 12A and 12B, the second side wall 2122 has a fourth mating section 21604 at a position opposing to the second base recess 2134 of the first side wall 2120. A fourth tongue section 2224 which resides between the second and the third tongue sections 2222, 2223 has a plurality of passages 2240 in the second surface 2202 of the tongue portion 2200. The fourth mating section 21604 at the first mating surface 2160 each has a plurality of passageways 2245 that extends from the first mating surface 2160 to the second mating surface 2165 and respectively communicate with the corresponding passages 2240 in the fourth tongue section 2224. The passageways 2245 in the first, the second and the third mating sections 21601, 21602, 21603 are arranged in a same row. The passageways 2245 in the fourth mating section 21604 are arranged in another row and this row is located lower than the row for the first, the second and the third mating sections 21601, 21602, 21603. The contacts 2300 include an additional set of a fourth set of contacts 2340 which may be used for signal transmission. The 4 sets of contacts respectively protrude through the passageways 2245 of their corresponding mating sections and are received in the corresponding passages 2240 of the tongue portion 2200.

In another embodiment of the present invention, at the position on the second side wall 2122 opposing to the first base recess 2132 of the first side wall 2120, there is another mating section (not shown) with a plurality of passageways 2245 and correspondingly, there is another tongue section (not shown) with a plurality of passages 2240 in the second surface 2202 of the tongue portion 2200 opposing to first base extension portion 2721. The passageways 2245 extend and communicate with the corresponding passages 2240 in the same manner as described earlier. In this embodiment, the contacts 2300 include an additional set of a fifth set of contacts (not shown) which may be used for signal transmission.

In another embodiment of the present invention, the electrical connector 2000 may further comprise a bonding device 140 (described earlier) coupled to at least one end wall 2210.

As can be seen, electrical connector 100 and its various other embodiments provide extensive versatility in connecting SAS headers and sockets, SATA headers and SAS sockets and interconnecting Micro SATA headers and sockets.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated thereof. It is intended that the scope of the invention be defined by the claims appended hereto, when interpreted in accordance with the full breadth to which they are legally and equitably suited.

The invention claimed is:

1. An electrical connector (100) for coupling two electrical connectors, comprising:

an elongated insulative housing (110) comprising a longitudinal base portion (115) having a first mating surface (160) and a second mating surface (165);

wherein the first mating surface (160) is configured to couple with a second complementary connector (48) by means of a central slot (130) defined between a first side wall (120), a second side wall (122) and a pair of end walls (124, 126), all walls extending from the base portion (115);

wherein the second mating surface (165) is configured to couple with a first complementary connector (45) by means of a tongue portion (200) and a pair of end walls (210), both the tongue portion (200) and the end walls (210) extending from the base portion (115), the tongue portion (200) comprising a first tongue section (221), a second tongue section (222) and a third tongue section (223); and a plurality of contacts (300) positioned in the housing (110); wherein the contacts (300) are grouped into a first set (310) and a second set (320) of contacts positioned in the first tongue and the second tongue sections (221, 222) respectively.

2. The electrical connector (100) of claim 1 wherein the tongue portion (200) comprises a first surface (201) and an opposite second surface (202) both extending in a longitudinal direction of the tongue portion (200), and wherein the first set (310) and the second set (320) of contacts are located in the first surface (201) of the tongue portion (200) and the third set (330) of contacts is located in the second surface (202) of the tongue portion (200).

3. The electrical connector (100) of claim 1 further comprising a bonding device (140).

4. The electrical connector (100) of claim 1 wherein each of said contacts (300) has two contact portions (302) and (303).

5. The electrical connector (100) of claim 1 wherein the tongue portion (200) comprises a first surface (201) and an opposite second surface (202) both extending in a longitudinal direction of the tongue portion (200), and wherein the first set (310) and the second set (320) of contacts are located in the first surface (201) of the tongue portion (200) and the third set (330) of contacts is located in the second surface (202) of the tongue portion (200); each of said contacts (300) having two contact portions (302) and (303).

6. An interconnect system having at least one an electrical connector for coupling two electrical connectors comprising:

an electrical connector according to claim 1; and wherein one or both of a first complementary connector (45) and a second complementary connector 48 is coupled to the electrical connector (100).

7. The interconnect system of claim 6 wherein the tongue portion (200) comprises a first surface (201) and an opposite second surface (202) both extending in a longitudinal direction of the tongue portion (200), and wherein the first set (310) and the second set (320) of contacts are located in the first surface (201) of the tongue portion (200) and the third set (330) of contacts is located in the second surface (202) of the tongue portion (200).

8. The interconnect system of claim 6 wherein at least one of the coupled complementary connectors (45, 48) is a SAS connector, or wherein the coupled first complementary connector (45) is a SAS socket and the coupled second complementary connector (48) is a SATA header.

9. The interconnect system of claim 6 wherein the coupled first complementary connector (45) is further coupled to a backplane of a printed circuit board (601).

10. The interconnect system of claim 6 wherein the coupled second complementary connector (48) is further coupled to a printed circuit board (602).

11. The interconnect system of claim 6 wherein the coupled first complementary connector (45) is coupled to the backplane of a printed circuit board (601) of a production test equipment (610).

12. The interconnect system of claim 11 wherein the coupled second complementary connector (48) is coupled to another printed circuit board (602) which is further coupled to a data storage device (620).

13. An electrical connector (2000) for coupling two electrical connectors, comprising:

an elongated insulative housing (2110) comprising a longitudinal base portion (2115) having a first mating surface (2160) and a second mating surface (2165);

wherein the first mating surface (2160) is configured to couple with a second complementary connector (2048) by means of a central slot (2130) defined between a first side wall (2120), a second side wall (2122) and a pair of end walls (2124, 2126), all walls extending from the base portion (2115);

wherein the second mating surface (2165) is configured to couple with a first complementary connector (2045) by means of a tongue portion (2200) and a pair of end walls (2210), both the tongue portion (2200) and the end walls (2210) extending from the base portion (2115), the tongue portion (2200) comprising a first tongue section (2221), a second tongue section (2222) and a third tongue section (2223); and a plurality of contacts (2300) positioned in the housing (2110);

wherein the contacts (2300) are grouped into a first set (2310), a second set (2320) and a third set (2330) of contacts positioned in the first tongue, the second tongue and the third tongue sections (2221, 2222, 2223)respectively.

14. The electrical connector (2000) of claim 13 wherein the tongue portion (2200) comprises a first surface (2201) and an opposite second surface (2202) both extending in a longitudinal direction of the tongue portion (2200), a first base extension portion and a second base extension portion (2721, 2722) and wherein the first base extension portion (2721) separates the first set of contacts (2310) from the second set of contacts (2320) and the second base extension portion (2722) separates the second set of contacts (2320) from the third set of contacts (2330) and wherein all 3 sets of contacts are located in the first surface (2201) of the tongue portion (2200).

15. An interconnect system having at least one an electrical connector (2000) for coupling two electrical connectors comprising:

an electrical connector according to claim 13; and wherein one or both of a first complementary connector (2045) and a second complementary connector 2048 is coupled to the electrical connector (2000).

16. The interconnect system of claim 15 wherein the tongue portion (2200) comprises a first surface (2201) and an opposite second surface (2202) both extending in a longitudinal direction of the tongue portion (2200), a first base extension portion and a second base extension portion (2721, 2722) and wherein the first base extension portion (2721) separates the first set of contacts (2310) from the second set of contacts (2320) and the second base extension portion (2722) separates the second set of contacts (2320) from the third set of contacts (2330) and wherein all 3 sets of contacts are located in the first surface (2201) of the tongue portion (2200).

17. The interconnect system of claim 16 wherein the electrical connector (2000) further comprises a bonding device (2140).

18. The interconnect system of claim 17 wherein the coupled first complementary connector (2045) is a Micro SATA socket and the coupled second complementary connector (2048) is a Micro SATA header.

19. The interconnect system of claim 18 wherein the coupled first complementary connector (2045) is coupled to the backplane of a printed circuit board (601) of a production test equipment (610).

20. The interconnect system of claim 18 wherein the coupled second complementary connector (2048) is coupled to another printed circuit board (601) which is further coupled to a data storage device (620).

* * * * *